United States Patent [19]

Toczyski et al.

[11] Patent Number: 4,984,550

[45] Date of Patent: Jan. 15, 1991

[54] METHOD AND A DEVICE FOR FEEDING OF SPARK IGNITION ENGINES WITH A FUEL MEDIUM

[75] Inventors: Zygmunt Toczyski; Stanislaw W. Kruczy ski; Henryk Frackiewicz; Janusz Lozi ski; Zdzislaw Chlopek; Wiktor Danilczyk; Jerzy Ranachowski; Janusz Janula; Lech Wolski, all of Warsaw, Poland

[73] Assignees: Polska Akademia Nauk Instytut Podstawowych Problemow Techniki; Politechnikawarszawski, both of Warsaw, Poland

[21] Appl. No.: 290,319

[22] Filed: Dec. 23, 1988

[30] Foreign Application Priority Data

Dec. 29, 1987 [PL] Poland ..... 269773
Dec. 29, 1987 [PL] Poland ..... 269774

[51] Int. Cl.[5] ..... F02M 51/00

[52] U.S. Cl. ..... 123/478; 123/472; 123/590

[58] Field of Search ..... 123/472, 478, 590; 239/102.2; 261/DIG. 48

[56] References Cited

U.S. PATENT DOCUMENTS 3,677,236 7/1972 Moss ..... 261/DIG. 48
4,038,348 7/1977 Kompanek ..... 239/102.2
4,105,004 8/1978 Asai et al. ..... 123/478
4,250,842 2/1981 Sutton ..... 123/472
4,590,915 5/1986 Yamauchi et al. ..... 123/522
4,725,003 2/1988 Lange ..... 239/102.2

FOREIGN PATENT DOCUMENTS 133087 11/1986 Poland .

*Primary Examiner*—E. Rollins Cross
*Attorney, Agent, or Firm*—Ladas & Parry

[57] ABSTRACT

The invention solves the problem of feeding spark ignition engines with fuel and obtaining high total efficiency of engines. The method is characterized by that for supply control the signals of pressures of the medium in determined sections of the suction pipe passage are used. The fuel medium is subject to ultrasonic vibration with the frequency of from 20 kHz up to 60 kHz. The atomized medium is treated with an air stream. The device is equipped with an ultrasonic unit /1/ provided with an ultrasonic transducer /21/ to atomize the medium, connected with the control system of the fuel medium supply before feeding the medium to cylinders. The ultrasonic unit /1/ is provided with at least one intermediate channel /16/ to feed the fuel medium, connected with at least two output channels /18/ leading to the radiant surface b /20/ of the waveguide /19/ The device provides for high production yield of the mixture.

13 Claims, 1 Drawing Sheet

METHOD AND A DEVICE FOR FEEDING OF SPARK IGNITION ENGINES WITH A FUEL MEDIUM

The subject of the invention is a method of feeding of spark ignition engines with a fuel medium, consisting in production of the fuel medium and control of its flow before feeding it to a cylinder, and a device for feeding of engines with a fuel medium and for production of a fuel medium.

Those skilled in the art know solutions consisting in feeding of engines with fuel or a mixture of fuel and air atomized pneumatically or by pressure.

The known solutions consist of individually designed units to control feeding of engines with a fuel medium, depending on design thereof.

The Polish patent specification No. 133087 puts forward the solution of a carburettor preparing an air-fuel mixture before feeding it to a cylinder. The carburettor comprises a throttling valve, a needle feeder, an ultrasonic atomizer, a mixing chamber. The outlet part of the ultrasonic atomizer is placed inside the fuel mixer chamber. The carburettor is provided with a reducing valve maintaining the appropriate pressure in the fuel tank, used for correction of the fuel medium flow.

Such a solution shows disadvantages which, in practice, preclude making use of the carburettor. In the said design, despite the fact that it enables breaking up on fuel particles, in practical use complete atomization of the fuel medium is not taken full advantage of, because in the suction passage fuel merges again into drops.

The object of the invention is to work out a method and a design of a device enabling more effective use of broken up fuel for feeding of spark ignition engines and to obtain high total efficiency of the engine.

According to the invention the method of feeding spark ignition engines consists in producing an air-fuel mixture (fuel medium) by continuous atomization of the fuel in the passage of the suction pipe leading to the engine cylinders. The rate of discharge of the fuel medium is controlled by absolute pressure signals of the medium flowing through the passage of the suction pipe in the section, in which the fuel medium is subject to ultrasonic vibration, and absolute hydrostatic pressure signals of fuel feeding the device, whereby filling of cylinders with the fuel medium is controlled by changing the resistance of flow of the mixture through the suction pipe passage by employing a throttling value into the suction pipe passage.

The rate of discharge of the pneumatically atomized fuel medium is controlled by signals of absolute pressure of the medium flowing through the suction pipe passage in the section, in which pneumatic atomization takes place, signals of absolute hydrostatic pressure of fuel feeding the pneumatic atomization system of the air-fuel mixture, and the ratio of the amounts of fuel and air in the said mixture.

The air-fuel mixture is supplied to the radiant surface of ultrasonic vibration simultaneously at least at two determined points of the surface being subject to ultrasonic vibration of the frequency of from 20 kHz up to 60 kHz, and then atomized fuel medium is entrained by supplied air.

According to the invention the device for feeding of engines with fuel is provided with an ultrasonic unit placed in the suction pipe passage and situated so that the axis of the unit forms together with the axis of the suction pipe passage an angle smaller from 15°.

An intermediate channel of the ultrasonic unit is connected with a first nozzle feeding the initially produced air-fuel mixture. The first nozzle is connected with an intermediate chamber to which a second nozzle to supply fuel and a third nozzle to supply air are connected.

The space over the surface of fuel in the fuel tank is connected by means of correction channels with the suction pipe passage.

The ultrasonic unit for atomization of the fuel medium is provided with a waveguide comprising at least one intermediate channel to feed the medium, connected with at least two output channels leading to the radiant surface of the waveguide. The intermediate channel runs along the entire length of the waveguide and is situated in the waveguide axis, whereas the output channels are located symmetrically on the radiant surface of the waveguide.

Axes of the output channels are inclined in relation to the axis of the intermediate channel at an angle of from 15° to 60°.

The solution according to the invention enables such breaking up of the fuel medium which, at combustion in spark ignition engines, provides for work of the engine with high total efficiency.

Location of channels according to the invention provides for high production yield of the fuel medium.

The solution according to the invention provides for atomization of the fuel medium within the range of the drop diameter of 10 μm up to 30 μm.

BRIEF DESCRIPTION OF THE DRAWINGS

The subject of the invention is explained in more detail in an example of its embodiment on the basis of a drawing in which.

Figure 1:
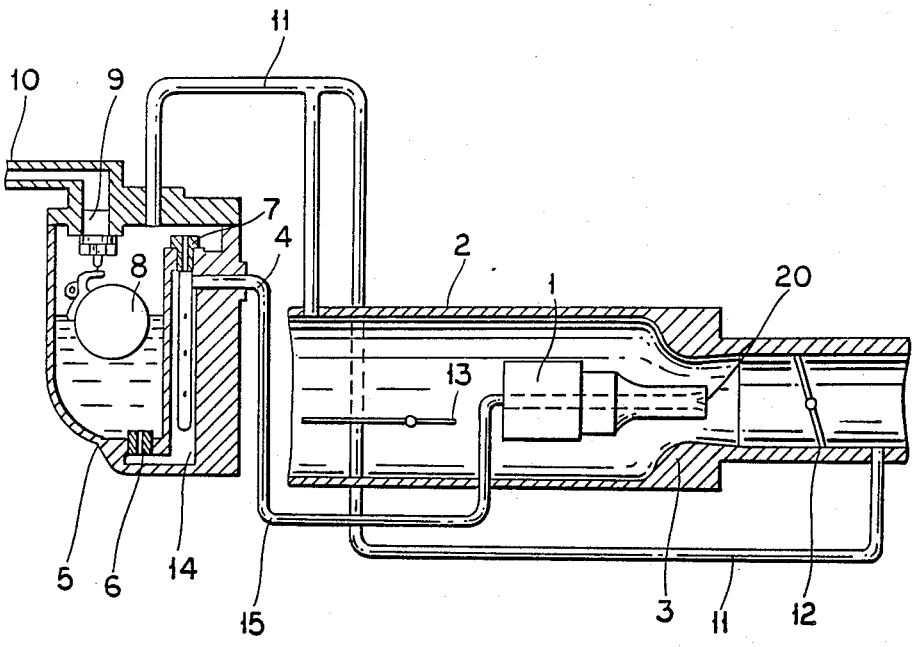
FIG. 1 presents schematically the device for feeding of a spark ignition engine with a fuel medium.
Figure 2:
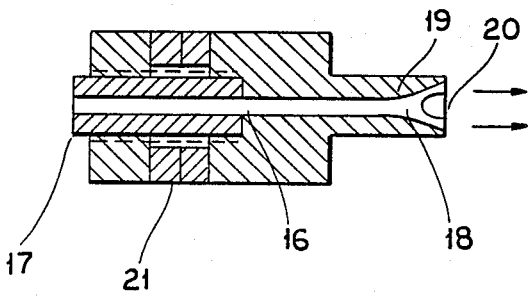
FIG. 2 presents schematically the section of an ultrasonic unit for atomization of the fuel medium.

The device is provided with an ultrasonic unit 1 with a piezoelectric transducer 21, placed in the axis of the passage of the suction pipe 2. The unit 1 is situated so that a radiant surface 20 of a waveguide 19 is in a reducing pipe 3 of the passage of the suction pipe 2. A fuel tank 5 is connected with an intermediate channel 16 of the ultrasonic unit 1 by means of a supply pipe 15 connected with a first nozzle 4. The first nozzle 4 is connected with an intermediate chamber 14 connected with a second nozzle 6 to supply fuel and with a third nozzle 7 to supple air an air-fuel mixture thus being provided to the transducer 21 via the pipe 15. The fuel tank 5 is provided with a float 8 to maintain the fuel level and with a cut-off valve 9 placed in the outlet of a stub pipe 10. In the passage of the suction pipe 2 there is a first throttling valve 12 and a second throttling valve 13 and between said throttling valves 12 and 13 the ultrasonic unit 1 is situated. The unit 1 comprises a piezoelectric ultrasonic transducer 21 placed in the waveguide 19 of mechanical vibration. In the waveguide 19 there are four output channels 18 arranged symmetrically on the radiant surface 20. Output channels 18 are inclined at the angle of 45° in relation to the axis of the waveguide and are connected with an intermediate channel which is situated in the axis of the waveguide 19. The intermediate channel 16 passes also through the axis of a compressing screw 17 and is connected with a pipe supplying the atomized medium.

The ultrsonic transducer 21 is supplied from a 25 W oscillator which is, in turn, supplied by a wiring system.

The fuel medium is supplied by output channels 18 to the radiant surface 20 wherefrom it is entrained by a stream of flowing air.

The fuel medium layer on the radiant surface 20 is made subject to ultrasonic vibration with frequency of 50 kHz.

To the ultrasonic unit 1 the pipe 15 supplies the fuel medium initially produced in the intrermediate chamber 14 to which the second nozzle 6 supplies fuel from the tank 5 and the third nozzle 7 supplies air. The fuel level in the tank 5 is maintained by means of the float 8 and the cut-off valve 9. To the tank 5 fuel is supplied by the stub pipe 10.

The method of controlling the flow of the fuel medium to feed spark ignition engines consists in employing as signals to control the rate of discharge of the fuel medium from the ultrasonic unit 1 the signals of absolute pressure of the fuel medium flowing through the passage of the suction pipe 2 in the section, in which the radiant surface 20 is placed, and the signals of absolute hydrostatic pressure in the tank 5. Changes of the flow rate and the coefficient of filling of cylinders with the fuel medium are made by correction of the resistance of flow of the fuel medium through the passage of the suction pipe 2 owing to utilization of the throttling value 12.

Absoute hydrostatic pressure of fuel in the tank 5 is controlled by the signal of absolute pressure of the medium in the determined section of the passage of the suction pipe 2.

At small loads of the engine or at its idle running the fuel medium can be atomized pneumatically.

Fuel is supplied to the radiant surface 20 of ultrasonic vibration simultaneously at four points of the said surface being subject to ultrasonic vibration of from 20 kHz up to 60 kHz.

Then the atomized fuel medium is entrained by an air stream flowing in the suction pipe 2.

Absolute hydrostatic pressure is controlled by pressure of air over the fuel surface in the tank 5. Absolute air pressure over the fuel surface in the tank 5 is controlled by signals of absolute pressures in a determined section of the passage of the suction pipe 2. In said sections there are correction channels 11. Signals of absolute pressures are fed to the space over the fuel surface in the tank 5 by means of correction channels 11. The rate of flow of the fuel medium feeding the cylinders of the engine is controlled by means of the first throttling valve 12. The rate of discharge of the fuel medium from the ultrasonic unit 1 at cold engine starting is controlled by means of the second throttling valve 13. The position of the first throttling valve 12 depends, in the case of warm engine starting, on the position of the second throttling valve 13.

List of denotations 1- ultrasonic unit
2- suction pipe
3- reducing pipe of the suction pipe passage
4- first nozzle of the fuel medium
5- fuel tank
6- second nozzle
7- third nozzle
8- float of the fuel tank
9- cut-off valve of the fuel tank
10- stub pipe
11- correction pipes
12- first throttling valve
13- second throttling valve
14- intermediate chamber
15- pipe feeding the fuel medium to the ultrasonic unit
16- intermediate channel
17- compressing screw
18- output channels
19- waveguide
20- radiant surface

What is claimed is:

1. A method of feeding a fuel medium through a suction pipe to a cylinder in a spark ignition engine comprising ultrasonically injecting the fuel medium into the suction pipe at a point upstream of the cylinder by means of a transducer supplied from a tank containing the fuel medium, and controlling the rate of flow of the fuel medium in response to the absolute pressure of the fuel medium within the suction pipe, the absolute hydrostatic pressure of the medium supplied to the transducer, and by controlling the resistance to flow of the injected fuel medium within the suction pipe.

2. A method according to claim 1 comprising controlling the absolute hydrostatic pressure of the fuel medium in response to the absolute pressure of the fuel medium within a predetermined portion of the suction pipe.

3. A method according to claim 1 including pneumatically atomizing the fuel medium at preselected conditions of operations of the engine.

4. A method according to claim 1 including supplying the fuel medium simultaneously to it least two spaced apart portions of a radiant surface of the transducer for injecting the fuel medium into the suction pipe, and vibrating the radiant surface at a frequency of from 20 kHz to 60 kHz.

5. A method according the claim 4 comprising entraining the injected fuel medium into an air stream for transport to the cylinder.

6. A method of feeding an air-fuel mixture through a suction pipe to a cylinder of a spark ignition engine, the suction pipe having a passage therethrough including first and second sections, the second section being downstream of and of smaller cross-sectional area than the first section, the method comprising continuously ultrasonically atomizing and injecting an air-fuel mixture supplied from a fuel tank into the suction pipe passage by means of a transducer, controlling the filling of the cylinder with the fuel mixture by means of a throttling value located downstream of the transducer, and controlling the discharge of the air-fuel mixture from the transducer by controlling the hydrostatic pressure within the fuel medium tank in response to the absolute pressure at a point within the second section of the suction pipe.

7. The method of claim 6 comprising controlling the hydrostatic pressure within the tank in response, also, to the absolute pressure within a point within the first section of the section pipe upstream of the transducer.

8. The method of claim 7 wherein the transducer includes an air-fuel mixture radiant surface, and including the steps of simultaneously supplying the air-fuel mixture to at least two spaced apart portions of the radiant surface, and vibrating the surface at a frequency of from 20 kHz to 60 kHz.

9. A system for feeding an air-fuel mixture to a cylinder of a spark ignition engine, the system including a suction pipe leading to the cylinder, an ultrasonic transducer for injecting an air-fuel mixture into the suction pipe at a first location therein, a fuel system including a fuel tank for supplying an air-fuel mixture to said transducer, a throttling value disposed within said pipe downstream of said first location for controlling the filling of the cylinder with the air-fuel mixture, and means for controlling the hystrostatic pressure within the tank for controlling the rate of discharge of the air-fuel mixture from the transducer.

10. A system according to claim 9 in which said transducer includes a main channel therethrough for the passage of the air-fuel mixture from said tank, and a radiant surface at the downstream end of the transducer for injecting the air-fuel mixture into the suction pipe at said first location, and said main channel terminating in at least two spaced apart output channels for leading the air-fuel mixture to spaced apart portions of said radiant surface.

11. A system according to claim 10 wherein said output channels have outlets which are arranged symmetrically on said radiant surface, and the axis of each of the output channels is inclined at an angle of 15 degrees to 60 degrees to the axis of said main channel.

12. A system according to claim 9 wherein said means for controlling the hydrostatic pressure within the tank comprises means for communicating to the tank the absolute pressure within the suction pipe at a point therein downstream of said first location.

13. A system according to claim 12 including means for also communicating to the tank the absolute pressure within the suction pipe at a point therein upstream of said first location.

* * * * *